US007946266B2

(12) United States Patent
Knecht et al.

(10) Patent No.: US 7,946,266 B2
(45) Date of Patent: May 24, 2011

(54) HYDRAULIC CIRCUIT, PARTICULARLY FOR CAMSHAFT ADJUSTERS, AND CORRESPONDING CONTROL ELEMENT

(75) Inventors: Andreas Knecht, Kusterdingen (DE); Dirk Pohl, Kirchentellinsfurt (DE); Jens Bartzsch, Rottenburg am Neckar (DE); Gordon Neudoerfer, Ulm/Maehringen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 275 days.

(21) Appl. No.: 12/283,882

(22) Filed: Sep. 15, 2008

(65) Prior Publication Data

US 2009/0071426 A1 Mar. 19, 2009

Related U.S. Application Data

(63) Continuation of application No. PCT/EP2007/051768, filed on Feb. 23, 2007.

(30) Foreign Application Priority Data

Mar. 17, 2006 (DE) ..... 10 2006 012 733
Jul. 2, 2006 (DE) ..... 10 2006 030 897

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | |
|---|---|---|---|
| 5,138,985 | A | 8/1992 | Szodfridt et al. |
| 5,645,017 | A | 7/1997 | Melchior |
| 5,657,725 | A | 8/1997 | Butterfield et al. |
| 6,267,041 | B1 | 7/2001 | Skiba et al. |
| 6,453,859 | B1 | 9/2002 | Smith et al. |
| 6,532,921 | B2 | 3/2003 | Sato et al. |
| 6,814,036 | B2 | 11/2004 | Palesch et al. |
| 6,941,912 | B2 | 9/2005 | Palesch et al. |
| 7,219,636 | B2 | 5/2007 | Sawada |
| 7,331,318 | B2 | 2/2008 | Schweizer |
| 7,387,097 | B2 | 6/2008 | Schmitt et al. |
| 2002/0062803 | A1 | 5/2002 | Sato et al. |
| 2003/0177991 | A1 | 9/2003 | Palesch et al. |
| 2004/0211379 | A1 | 10/2004 | Palesch et al. |
| 2005/0072397 | A1 | 4/2005 | Sluka et al. |
| 2005/0241603 | A1 | 11/2005 | Palesch et al. |
| 2005/0257762 | A1 | 11/2005 | Sawada |
| 2006/0201463 | A1 | 9/2006 | Schweizer |
| 2006/0225791 | A1 | 10/2006 | Patze et al. |
| 2007/0074687 | A1 | 4/2007 | Bosl-Flierl et al. |
| 2007/0266971 | A1 | 11/2007 | Bosl-Flierl et al. |

FOREIGN PATENT DOCUMENTS

DE 36 01 643 7/1987

(Continued)

OTHER PUBLICATIONS

Smith et al., "A Camshaft Torque-Actuated Vane-Style VCT Phaser", pp. 43-50 (SAE International, Jan. 2005).

(Continued)

*Primary Examiner* — Zelalem Eshete
(74) *Attorney, Agent, or Firm* — Lipsitz & McAllister, LLC

(57) ABSTRACT

The invention relates to a valve and suitable hydraulic circuit, especially for camshaft adjusters of an internal combustion engine. The hydraulic circuit comprises a number of check valves or two-way valves operating as check valves, in order to provide a rapid camshaft adjuster with a high regulating quality.

13 Claims, 11 Drawing Sheets

FOREIGN PATENT DOCUMENTS

| | | |
|---|---|---|
| DE | 42 10 580 | 10/1993 |
| DE | 198 44 669 | 3/2000 |
| DE | 101 58 530 | 8/2002 |
| DE | 102 05 415 | 8/2003 |
| DE | 10 2005 023 056 | 12/2005 |
| DE | 10 2005 004 281 | 1/2006 |
| DE | 10 2005 013 085 | 1/2006 |
| DE | 602 07 308 | 3/2006 |
| EP | 0 388 244 | 9/1990 |
| EP | 1 347 154 | 9/2003 |
| EP | 1 447 602 | 8/2004 |
| GB | 1 212 327 | 11/1970 |
| WO | 99/67537 | 12/1999 |
| WO | 2004/088094 | 10/2004 |
| WO | 2004/088099 | 10/2004 |

OTHER PUBLICATIONS

Pohl, Dirk, et al., "Vanecam® FastPhaser-Camphasing System for Improvement of Phasing Rate and Reduction of Oil Consumption", Konfernz Haus der Technik Variable Ventilsteuerung, 17 pages, Feb. 2007.

HYDRAULIC CIRCUIT, PARTICULARLY FOR CAMSHAFT ADJUSTERS, AND CORRESPONDING CONTROL ELEMENT

This application is a continuation of PCT/EP2007/051768 of Feb. 23, 2007 and which claims the benefit of German application number 10 2006 012 733 of Mar. 17, 2006 and German application number 10 2006 030 897 of Jul. 2, 2006, each of which is incorporated herein by reference in their entirety and for all purposes.

BACKGROUND OF THE INVENTION

The invention relates to a hydraulic circuit suitable for motor vehicles and particularly hydraulic circuits having a camshaft adjuster, and also to corresponding control elements.

In the hydraulic circuits of motor vehicles, hydraulic pistons are used to vary the position of a connected mechanical element, such as a camshaft for example. One type of hydraulic piston may be a swivel-motor-type rotary piston or even a radial piston, also known as a hydraulic motor, which is capable of varying its position in a gyratory manner within a certain angular range.

The piston moves within a housing, the piston forming, on both sides, hydraulic spaces which are varied in an oppositely oriented manner. This means that, if one hydraulic chamber grows as a result of a variation in the position of the hydraulic piston, the corresponding chamber located opposite the piston is reduced in corresponding measure, and vice versa. As is known, the hydraulic chambers are configured in the same manner, so that the growth of one hydraulic chamber, volume-wise, contributes to the same reduction, volume-wise, in the other, corresponding chamber. In this case, the variations in volume are equivalent or even identical in terms of amount.

One very important hydraulic circuit of a motor vehicle is the camshaft-adjuster circuit which starts in the engine sump and which adjusts, via suitable valves and a swivel-motor-type camshaft adjuster, the relative location of the camshaft in relation to a driving shaft, such as the crankshaft or another camshaft for example. The adjustments take place in the direction of an earlier or later point in time with respect to the angle of rotation of the driving shaft or with respect to the position of the piston. In contrast to, for example, closed systems which have a single hydraulic circuit, in just the same way in which known motor-vehicle transmissions are constructed, a system of this kind is regarded as an open system which operates with variable volumes of oil, because a number of hydraulic circuits are present in the internal-combustion engine, starting within the engine sump.

Other known hydraulic circuits in the motor vehicle may include, for example, transmission control systems which are attached, either to the central hydraulic circuit, which is supplied with engine oil, or to an independent, self-contained hydraulic circuit.

Particularly in the case of multiple hydraulic loadings resulting from a strung-on hydraulic system, motor vehicle manufacturers are calling for the smallest possible loading on the hydraulic pump, which has to supply all the consumers. This lowers the parasitic loadings on the internal-combustion engine, and this, in turn, contributes to increasing the efficiency.

Numerous ways in which the over-supplying of the hydraulic consumers can be reduced can be inferred from US 2005/0072397 A1, which primarily addresses the delivery quantities of the hydraulic circuit. According to one aspect of the invention described therein, rotational-speed-dependent delivery quantities from an oil pump which is mechanically coupled directly to the internal-combustion engine are reduced by additional delivery or storage apparatuses.

Another important call from internal-combustion engine manufacturers is the desire to be able to incorporate the quickest possible camshaft adjusters in the internal-combustion engine. As a rule, the speed of adjustment of the camshaft adjusters is increased by correspondingly high oil delivery quantities. Many motor vehicle manufacturers are calling for adjusters with speeds of adjustment of 100°/sec. Adjusters whose speed of adjustment is indicated by means of a single extreme value are often encountered in the literature. What is important, however, is the speed of adjustment over all the rotational speeds of the internal-combustion engine, which speed should be as constant or linear as possible. Thus, in some cases, speeds of adjustment of more than 200°/sec at certain points are described, which, on closer investigation, have a purely singular character with respect to the rotational speed. If these data are studied more closely, it can be established that they often relate to high rotational speeds with low oil temperatures. It is true that a quick camshaft adjuster is obtained by incorporating a larger oil pump, but the output or efficiency of the internal-combustion engine goes down.

From published specification EP 0 388 244 A1, a system is known which, in a completely enclosed manner and with two anti-parallel circuit arrangements, adjusts, via a valve, the relative location of a driven shaft in relation to a driving shaft by equalising, from one chamber to the second chamber, a volume of oil which is constant overall. The teaching of the printed specification, which is summarised, for example, in the main claim and in FIGS. 3 and 7, is to be viewed more as theoretical since, as is known, leakages occur in the hydraulic circuit of a camshaft adjuster.

In the technical literature, particularly in the article "A camshaft torque-actuated vane-style VCT phaser" by authors Frank Smith and Roger Simpson, reprinted as SAE Article 2005-01-0764, it is proposed, for example, that the pump of the hydraulic circuit be relieved of pressure through the fact that the pump continues to compensate for leakages from the adjuster only while a hydraulic compensating system which is normally closed is present between the two oppositely oriented chambers of the adjuster. The speeds of adjustment put forward in the charts lead to the assumption that the system put forward only operates with suitably large quantities of oil in the hydraulic circuit of the adjuster. In conventional engines in small motor vehicles, which are known, above all, in Western Europe and Japan, the system described would probably find few applications because engines of this kind are supposed to manage with markedly smaller filling quantities (often less than 5 litres of engine oil). A patent which belongs in the same category can be seen in U.S. Pat. No. 5,657,725.

Utilisation of the moment fed into the camshaft adjuster by the camshaft for the purpose of adjusting the camshaft adjuster into an early position is known from DE 101 58 530 A1 and DE 10 2005 023 056 A1. Whereas DE 101 58 530 A1 aims to use the technique in order to pass into the early position more swiftly when the engine drops from a hot-running phase into a lower rotational-speed range, DE 10 2005 023 056 A1 aims to ensure, above all in the event of a failure of the supply pump, that the camshaft is twisted into a position of the kind in which further operation in the early position is possible. For this purpose, DE 101 58 530 A1 uses a non-return valve with a pressure-equalising valve in the camshaft adjuster itself, whereas DE 10 2005 023 056 A1 proposes to arrange a number of non-return valves around the pump.

DE 602 07 308 T2 proposes using a valve or a changeover switch which differentiates between two states, namely between a high rotational-speed range in which an oil pressure-actuated camshaft adjustment takes place, and a low rotational-speed range in which a camshaft moment-actuated camshaft adjustment takes place. The changeover switch switches to and fro between the two states in dependence upon the operating conditions.

As can be seen, the prior art teaches the utilisation of camshaft moments for certain modes and types of operation.

The hydraulic circuits have accordingly been designed for the tasks set.

In order to improve the speed of adjustment, it is known from DE 102 05 415 A1 or its American relative U.S. Pat. No. 6,941,912 B2, which are based on in-house developments by the Applicant, to interconnect a group of valves, in particular four valves that work with pistons, in order to clear a bypass line through which hydraulic medium can be transferred from one chamber to the other for the purpose of increasing the speed of adjustment. Apart from that, the system is an open one which is supplied from a delivery pump. From one of the exemplified embodiments, it can be seen that a bypass arrangement can be produced by means of a nested double-piston arrangement of the hydraulic shunt. According to this exemplified embodiment, the bypass arrangement is arranged, in a manner uncoupled from the shunt and independently, with a valve group which comprises a number of pistons and is set up in the rearward wall of the camshaft adjuster.

In the present invention, an approach has therefore been sought after for the purpose of designing a hydraulic system which offers a high, and also virtually constant, speed of adjustment of the hydraulic piston, as far as possible independently of the operating parameters; which at the same time offers a high regulating quality; which represents a low load for the oil pump of the internal-combustion engine; and which can be incorporated even in small-volume engines, e.g. 1.3 or 1.8-litre engines which have fewer gas exchange valve restoring springs than, for example, the V6 engine in the technical article described above.

In camshaft adjusters, the regulating quality is indicated, inter alia, in angular degrees within which the camshaft adjuster oscillates, although a defined, constant position according to the pressure loading from the supply pump is desirable. The deviation from the theoretically set position in angular degrees is then designated as the regulating quality.

The inventors also set themselves the object of being able to use the system to be designed, even in fully variable valve drives which are described in greater detail in, for example, patent applications WO 2004/088094, WO 2004/088099 and U.S. Pat. No. 6,814,036 A or EP 1 347 154 A2.

SUMMARY OF THE INVENTION

In contrast to the utilisation of a pure alternating moment which originates, for example, from the gas exchange valve restoring springs and the camshaft in a camshaft adjuster, or as a result of a purely external adjustment by means of pressure-loaded hydraulic medium, what is proposed, according to the present invention, is a hydraulic system which can manage both with rising and also with purely alternating moments. Depending upon the loading and the reaction of the shaft, such as the camshaft for example, which is being driven and adjusted, rising moments and alternating moments occur alternately. The engine control unit which serves to activate the hydraulic shunt, for example the camshaft adjuster valve, is no longer assigned to alternating moments which are constantly being fed in but, in one form of embodiment, merely has to actively activate a single valve, while the rest of the hydraulic circuit is operated passively.

In this context, alternating moments are moments at the hydraulic piston which have, intermittently, both a positive variable constituent and also a constituent which is negative at times. On the other hand, rising moments are ones which, although they vary in terms of amount, nevertheless remain within the same arithmetic-sign range of the moment characteristic over a fairly long space of time of a number of milliseconds.

Acting upon the hydraulic circuit of the motor vehicle, which circuit has a hydraulic piston which moves in an oppositely oriented manner and has at least two hydraulic chambers, is an external moment which acts in either an alternating or a rising manner. The hydraulic circuit performs a positional variation as a result of differing pressure loading, which can be drawn from a hydraulic pump, on the oppositely oriented hydraulic chambers. In addition to a hydraulic adjustment of the shunt, preferably embodied by a valve, which feeds the pressure loading on the hydraulic medium to the piston, the negative constituent of the alternating moment is utilized to vary the position of the hydraulic piston. On the other hand, the rising constituent of the moment is faded out by other means, such as non-return valves for example. The selective utilisation of moments, particularly as a result of the clearing via non-return valves, leads to linearising of the speed of adjustment via the rotational speed of the motor, while the ongoing utilisation of the smallest possible hydraulic supply from a pump for adjusting the piston ensures the high speed of adjustment, even in the case of purely rising constituents of the moment.

According to one configuration, hydraulic connecting paths from one chamber of one type to the working connection for the other type of chamber are provided in each case. This results in a hydraulic circuit with a valve. The valve is capable of passing the hydraulic pressure, which can be derived from the negative constituent of the alternating moment on one working connection for one type of chamber in each case via at least one non-return valve, through to the second working connection of the other type of chamber in each case. An alternating passing-through operation may take place. Moreover, the pressure loading on the pressure-loaded connection is passed on to the second working connection. The alternating passing-through of the hydraulic medium can be carried out both from the one chamber and also from the other chamber to the corresponding, oppositely oriented chamber.

If the hydraulic circuit of the motor vehicle is constructed in the context of a camshaft adjuster, the hydraulic circuit is one which belongs to an internal-combustion engine and operates with engine oil and whose hydraulic piston is a swivel-motor-type or helically-toothed camshaft adjuster into which the moments of at least one camshaft are fed.

The size of the gas exchange valve springs, and the number of the latter, has an influence on the frequency and nature of the moments fed in from the camshaft to the camshaft adjuster. A manufacturer of camshaft adjusters is called upon to offer camshaft adjusters for internal-combustion engines which are to be as universally usable as possible. A motor vehicle manufacturer would often like to be able to use one and the same camshaft adjuster for different engines belonging to various production series. However, the manufacturer of camshaft adjusters may make specifications regarding the hydraulic circuit, so that it is possible to improve the behaviour of the camshaft adjuster by choosing a suitable valve or suitable valve assembly, and an adjuster together with the hydraulic circuit arrangement.

If use is made of swivel-motor-type camshaft adjusters, closer consideration is given to the fluctuations in moment, the alternating moment and the rising moment which are fed to the camshaft adjuster by the camshaft, instead of to forces, so that, in these cases, reference is made to moment instead of force. As is currently known to every physicist or machine-manufacturer, it is possible to ascertain the force F from the moment M, and to derive, from the force F, the corresponding hydraulic pressure P, where r represents the radius of the swivel-motor-type camshaft adjuster and x and y describe the area. The formulae for this are:

$$M = \int F * \partial r \text{ and}$$

$$P = \frac{F}{\iint \partial x * \partial y}$$

The function of the non-return valves, which only feed in the negative constituent of the alternating force upstream of the shunt again, can be described as a bypass. According to one exemplified embodiment, a suitable place for feeding in the constituent again is the P connection, that connection of the shunt which is continuously loaded with pressure. The non-return valve or, if a number of non-return valves are present, the non-return valves is/are then arranged in such a way that feeding-through of the hydraulic pressure originating from the chambers of the piston is made possible only in the direction of the pressure side of the shunt. By using non-return valves in the context of constructing the bypass, a technically elegant solution has been found as to how it is possible, for example by means of the teaching which is described in greater detail in DE 10 2005 013 085, to construct non-return valves, which function reliably over a long period and have few components, in the case of cartridge valves.

The diverting activity within the hydraulic circuit of the motor vehicle functions if the amount of the pressure arising from the alternating force exceeds the other pressure in one of the infeed lines to that chamber of the piston which is increasing in size, and then clears the non-return valve which is present for determining the direction. The non-return valves may be arranged in such a way that the two hydraulic chambers of the piston are in communication indirectly. In this case, a connection is to be taken via the shunt in order to pass from one chamber to the other. Another variant is direct connection, in the case of which a direct hydraulic connection from one hydraulic chamber to the other is provided when the non-return valve is opened. Which of the two variants is to be chosen depends upon the particular framework conditions for that hydraulic circuit of the motor vehicle which is to be provided. According to one variant of embodiment, if the cylinder head in which the shunt is arranged offers sufficient space to construct hydraulic lines in a multiple manner, an indirect connection via the hydraulic shunt can be designed. Should it be desired to permit the most rapid transfer possible, if possible with little leakage, a direct connection, via the non-return valves, from one chamber of the piston to the other is to be chosen.

The hydraulic shunt is pretensioned. Suitable solutions for generating the pretensioning may include:

a hydraulic solution; a mechanical solution or a combined mechanical/hydraulic solution; an electrical solution; a magnetic solution; or a combined electromagnetic solution. Hydraulic pretensioning arrangements are chosen if it is possible to work with a number of hydraulic quantities. Mechanical pretensioning devices are, as a rule, set once and do not have to be further calibrated thereafter. Electrical and magnetic pretensioning devices can be satisfactorily routed to the motor vehicle control unit for the internal-combustion engine. This makes software-type influencing possible.

According to one exemplified embodiment of the present invention, one of the non-return valves is arranged in the blocking direction in such a way that it is possible to establish a connection from that input side of the hydraulic shunt which is loaded with hydraulic pressure to an output side of the hydraulic shunt. According to this form of embodiment, the output side of the hydraulic shunt is in communication with one of the hydraulic chambers of the piston. The form of embodiment proposed is a really compact variant. It excels because of its elementary nature and simplicity.

According to another exemplified embodiment, the choice of direction of the hydraulic piston can be adjusted by means of a hydraulically controlled valve. In the context of the hydraulic speeds, a system which is hydraulically very stable is produced as a result of its feedback loop.

According to a further development which is also advantageous, a hydraulically controlled valve serves to connect the pressure loading of one of the hydraulic chambers to the other hydraulic chamber. In this instance too, the hydraulic correlations ensure stabilisation of the hydraulic circuit.

With the unpublished findings from DE 10 2005 013 085 A1 in mind, it is possible to provide an integrated component which connects the non-return valves to the hydraulic shunt by built-in strips.

The whole arrangement can be integrated still further if the valve and the camshaft adjuster are combined to form a camshaft adjuster with central valves. In this case, the central valve is arranged either in the axial center of the camshaft adjuster or in the form of an axial prolongation of the latter. The central valve or the arrangement comprises a pressure-reducing valve, a non-return valve or a two-way valve. By means of the disclosure of this invention, a motor vehicle technician or hydraulics specialist has the possibility of selecting suitable components in order to optionally implement the invention with, for example, a pressure-reducing valve and three non-return valves in the camshaft adjuster.

According to one favorable further development, the hydraulic circuit may comprise a partial hydraulic circuit which is built up from three hydraulically controlled valves. The three valves take on the task of alternately obstructing or clearing two feed lines and two return lines.

The hydraulic circuit may be designed in such a way that the essential component is a valve. The valve in question is then a valve for a hydraulic circuit of a motor vehicle. The valve is supposed, particularly in the case of a swivel-motor-type camshaft adjuster, to pass through the fluctuations in moment, which may occur both as alternating moments and as rising moments, with the hydraulic pressure which is passed on from the pressure source to the pressure-loaded connection of the valve. A typical valve for camshaft adjusters may be a valve with four connections. One connection is the connection which is joined directly or indirectly to the continuous pressure sources. It is the P connection. Another connection is the tank connection which, as a rule, leads into the engine sump. Working connections which lead to the chambers of the hydraulic piston are alternately switched through or interrupted, depending upon the switching position of a hydraulic piston inside the valve. The valve feeds the hydraulic pressure into one of the chambers of the swivel motor intermittently, without fluctuations in the moment.

Another hydraulic pressure, which originates from the negative constituent of the alternating moment, is produced in the hydraulic circuit. The hydraulic pressure which comes from the negative constituent of the alternating moment can always be fed out, at least via one non-return valve. The pressure fed out is passed through to the second working connection. The state described is a more unusual, or special, state because, most of the time, the pressure loading which originates from the pressure-loaded connection of the hydraulic shunt or of the valve, is passed on to the corresponding working connection. A continuing utilisation of pressures takes place within the hydraulic circuit, beyond the continuous pressure. The bypass line resulting from the non-return valve utilizes the negative moment, while the standard adjustment is ensured by that standard position of the hydraulic piston which is chosen. In addition to an advantageous utilisation, energy-wise, of additional pressure resources, this feedback evens out or improves the regulating quality and even the speed of adjustment.

Two non-return valves are used, particularly for passing through the negative constituent of the alternating moment. The non-return valves are arranged in such a way that they prevent a flow of hydraulic medium from the pressure-loaded connection of the valve to the working connection if the pressure, calculated in accordance with the above formula, resulting from the amount of the negative constituent of the alternating moment exceeds, absolutely, the pressure on the pressure-loaded connection. The valves function, so to speak, as directional throttles. Viewed in this way, even valves having two switching states count as non-return valves according to the invention, if they are to perform the same function. Instead of a strip, which is particularly advantageous, it is also possible to choose technically subordinate solutions without departing from the range of equivalence or the meaning of the term "non-return valve".

One suitable measure is to pretension the valve, particularly with a spring, and to construct the entire valve as a cartridge valve. For a camshaft adjuster, such a valve is described as a "camshaft adjuster cartridge valve". Non-return valves which constitute a non-return strip are particularly suitable. The strip is shaped into a ring. As a result of the locking of the strip, the valves open in one direction and close in the other direction. The cartridge valve as a whole thus forms an integrated component with non-return valves. All the cross-connections inside the cartridge valve are produced by transverse bores and clearances in the sleeve and in the piston.

The hydraulic piston is able to adopt two or three switching positions. In actual fact, ranges of switching positions are physically available. The valve is configured as a distributing valve. In the first position, which results from pretensioning but needs no active activation of the piston, an opening position is available. This is a parallel circuit arrangement. A parallel circuit arrangement is understood to be one in which the pressure-loaded connection P effects feeding to the first working connection A. The second working connection leads to the tank connection. If there is a connection from the P connection to the second connection B, and a connection from the first working connection A to the tank connection T, this is referred to as a "cross-connected opening position". The position opening into the parallel circuit arrangement and the position opening into the cross-type circuit arrangement represent two out of the two or three positions which are available. The third position may be an interrupted or closed position. It may be arranged on the piston in such a way that the interrupted position lies between the first and the second opening position. Naturally, use may also be made of valves which have more than three positions along their piston.

According to one configuration, the first non-return valve is arranged in such a way that pressure peaks in the first working connection are fed through by the non-return valve. In the meantime, the second non-return valve is arranged in such a way that pressure peaks in the second working connection can be fed through via this non-return valve. A third non-return valve is configured as a pump-protecting valve. As protection for the pump, one or two non-return valves are installed in the valve in the reverse direction, in a counter-blocking manner. Thus it is only ever possible for one of the two non-return valves, which are combined to form a pair, to open. The valve may be incorporated in the cylinder head of the internal-combustion engine or even in the camshaft adjuster itself.

Contrary to practical embodiments of the bypass which are already known and in which nested piston arrangements are to be constructed, in the present case a bypass line is routed via the shunt or a separately assigned valve. This practical embodiment considerably reduces the outlay on components and ensures a piston arrangement, inside the valve, which is easy to produce. Without producing a slide within a slide, as has already been investigated in other in-house solutions, a system has been provided which can be actuated passively. The system works without outside intervention, although it is also possible to produce the system in such a way that outside intervention is possible, e.g. via a separate control valve, is possible if desired. The absolute amount of the pressure peaks, which is the result of the force or moment, has no effect on the actual controllability. This fact increases the regulating quality. The pressure differences in the system are also of subordinate importance. Within the meaning of this invention, "non-return valve" is understood to also mean, in addition to what has been disclosed above, any other suitable arrangement which has a directional influence on the result.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
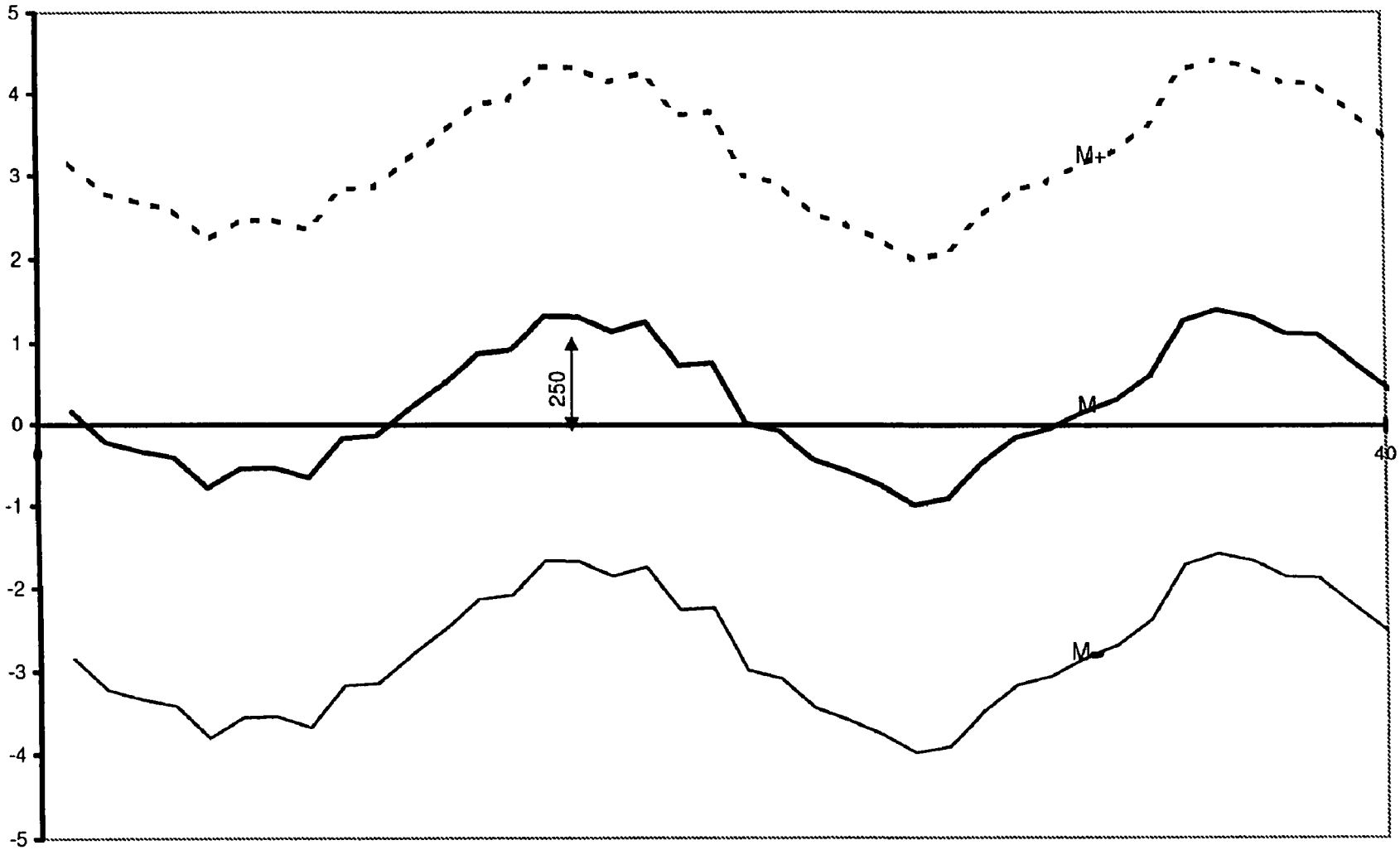
FIG. 1 shows an example moment characteristic.

As can be seen in FIG. 1, the moments which can be measured at the camshaft adjuster in this way, as is represented in a stylised manner for example, fluctuate. The time, that is to say 40 ms in the present example, is plotted on the X-axis. The moment is plotted in powers of ten in Nm on the Y-axis. It can be seen that the moment is not constant but varies almost continuously in a manner contingent upon oscillating behaviour, position of the camshaft, ignition points of the internal-combustion engine, points at which the gas exchange valves open, etc. The overall moment M is made up of a negative constituent M− and a position constituent M+. In an internal-combustion engine, states also occur in which only a rising moment is present, and then no change in the arithmetic sign takes place. In the case of a rising torque, therefore, only the (M+) or (M−) characteristic at the camshaft adjuster is measured. While the internal-combustion engine is running, there occur both phases of a rising moment (only M+ or only M−) and phases of an alternating moment M in which constituents can occur which are both sometimes negative and sometimes positive. As long as the adjuster remains in the rising state, the moment (or force) cannot be utilized for improving the regulating quality. In the event of a change in the arithmetic sign of the moment, however, the oppositely oriented moment can be successfully utilized. A circuit is therefore desired which is capable, by itself and without active intervention, of utilising the oppositely directed moment in the most favorable manner possible, so that the pressure 250 can be derived from it.

FIGS. 2 to 6 disclose different exemplified embodiments of the invention, wherein which of the hydraulic diagrams represented can be used depends upon the actual framework conditions in the design of the hydraulic circuit of the motor vehicle, particularly of the hydraulic circuit of the camshaft. Components which are similar, or have similar functions, have been shown with the same reference symbols in all the exemplified embodiments in FIGS. 2 to 6. For reasons of legibility, not all the parts which are similar are named individually in every exemplified embodiment, but the reader is referred to similar forms of embodiment for a more detailed understanding.

Figure 2:
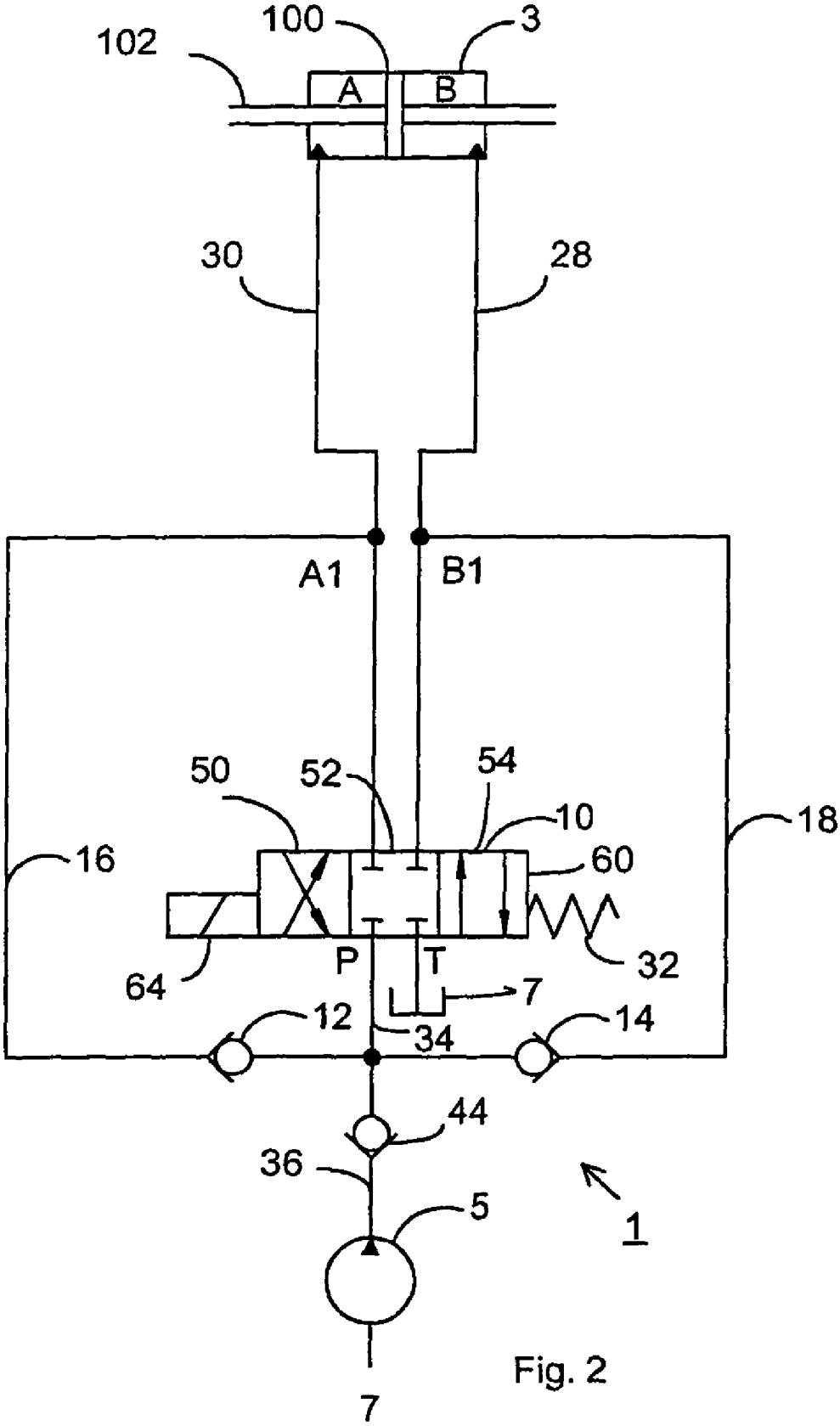
FIG. 2 shows a hydraulic circuit in accordance with an example embodiment of the present invention.

Represented in the exemplified embodiment according to FIG. 2 is a motor vehicle hydraulic circuit 1 having a hydraulic piston 3 which may be a camshaft adjuster 100. A camshaft adjuster 100 has at least two chambers A and B. As a rule, these chambers act repeatedly in an alternate manner. Two infeed lines 28, 30 reach the camshaft adjuster from the secondary side of the hydraulic shunt 10.

The lines may be chosen so as to be as short or long as desired, depending upon whether the hydraulic shunt 10 is arranged far away at another location in the internal-combustion engine, or whether the shunt 10 and camshaft adjuster 100 are integrated to form a single component. On the primary side, the hydraulic shunt 10, which is spring-pretensioned by the spring 32 and is electrically adjustable via the electrically controlled plunger 64, has a pressure-loaded connection P and a tank connection T which leads into the engine sump 7. The pressure-supplying line 34 leads to the pressure connection P. On the secondary side of the hydraulic shunt 10, a first and second non-return line 16, 18 are connected to the working connections A1, B1, for example by means of tap lines or transversely bored lines. The first non-return line has a first non-return valve 12, and the second non-return line 18 has a second non-return valve 14. The non-return valves lead to the pressure-supplying line 34. The first non-return line 16 acts upon the first working connection A1, and the second non-return line 18 acts upon the second working connection B1. The pressure-supplying line 34 contains a summation point to which both the non-return valves 12, 14 and also a pump-protecting valve lead. The pump-protecting valve 44 and the non-return valves 12, 14 are arranged in a clearing manner with respect to the junction point. Another pressure-supplying line 36, which is in communication with the hydraulic pump 5, is provided on the side that feeds in to the pump-protecting valve 44. In the present example, a 4/3-way valve 60 has been chosen, which has a position opening into the cross-type circuit arrangement 50, a blocking position 52 and a position opening into the parallel circuit arrangement 54. When the electrically controlled plunger 64 is not supplied with current, the spring 32 presses the hydraulic piston of the valve 10 into the position opening into the parallel circuit arrangement 54. Alternatively, another first position may be chosen, depending upon the construction of the valve. If the pump 5 is working satisfactorily, the pump-protecting valve 44 opens when in the state devoid of hydraulic oil, and hydraulic medium flows out of the engine sump or oil pan 7 via the valve 10 and into the first hydraulic chamber A which grows and consequently reduces the second hydraulic chamber B. If the electrically controlled plunger 64 adjusts the hydraulic piston of the valve 10 and the position opening into the cross-type circuit arrangement 50 is set, the hydraulic medium is conducted away, out of the chamber A via the working connection A1, to the tank connection T, while fresh hydraulic medium, which is delivered by the hydraulic pump 5, is fed into the second hydraulic chamber B. The hydraulic chamber B is thereby enlarged, while the hydraulic chamber A becomes correspondingly smaller. If the camshaft adjuster is subjected, in addition to the normal adjustment, to the feeding-in of a moment or force, and if this feeding-in operation intensifies the adjustment, the respective non-return valve 12, 14 is opened. As a result of a rising pressure in the junction point for pressure, the pump-protecting valve 44 effects blocking while the non-return valve 12 or the non-return valve 14 is being opened by the feeding-in of force. Because of the hydraulic routes involved, momentary but almost immediate alternate switching-over between the types of valves does not take place.

Figure 3:
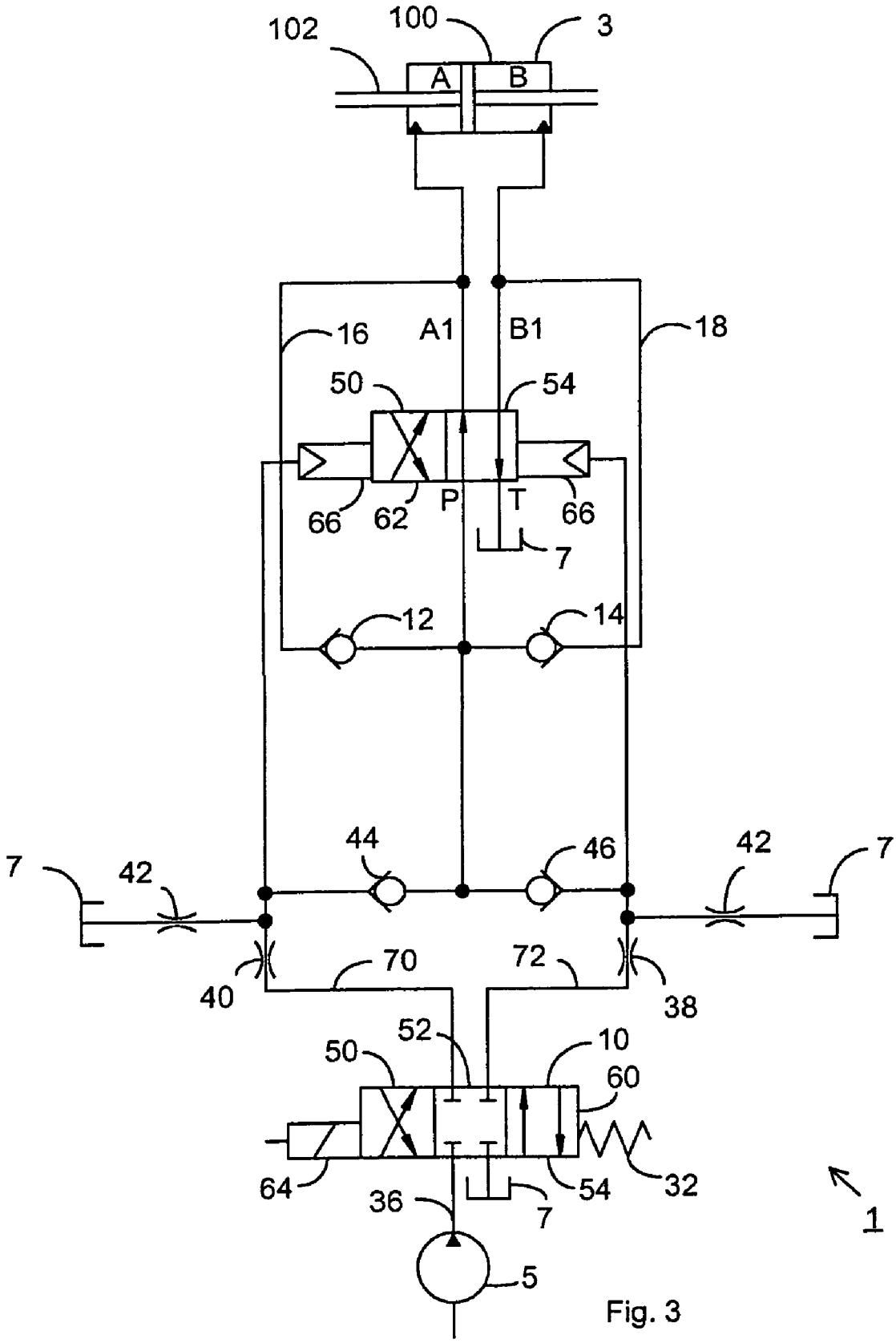
FIG. 3 shows a hydraulic circuit in accordance with a further example embodiment of the present invention.

Another exemplified embodiment of a hydraulic circuit according to the invention can be seen in FIG. 3. In this exemplified embodiment, a valve 10 has also been chosen as the hydraulic shunt, but the valve is in direct communication with the hydraulic pump 5 via a pressure-supplying line 36, while another connection of the valve 10, which is a 4/3-way valve 60, leads to the engine sump 7. The 4/3-way valve 60 has a first state, the position opening into the parallel circuit 54, which is adopted as a result of spring pretensioning by the pretensioning spring 32 when the electrically controlled plunger is not supplied with current or is supplied with a low current, and also a blocking position 52 and a position 50 opening into the cross-type circuit arrangement. On the secondary side, the valve is routed to non-return valves 44, 46, which work as pump-protecting valves, on the one side, and to hydraulically controlled plunger connections 66 belonging to another valve, which is a 4/2-way valve 62 with two positions. The throttles 38, 40 represent supply throttles. The connection of the valve 10 through the supply throttles 38, 40 takes place via distributing lines 70, 72. The pump-protecting valves 44, 46 point, together with non-return valves 12, 14, towards a P connection of the 4/2-way valve 62. The four connections of the valve 62 are the P connection for the pressure supply, the T connection for the tank, a first working connection A1 and a second working connection B1. The working connections A1, B1 lead, via infeed lines 28, 30, to the hydraulic chambers A, B of the hydraulic piston 3 or camshaft adjuster 100, which are fixedly connected to the camshaft 102 in a mechanical manner. The hydraulic chambers A, B are also connected to non-return lines 16, 18 in which the non-return valves 12, 14 are incorporated in an oppositely directed manner in relation to one another. Leakage throttles 42 in the infeed lines point towards the pan in the engine sump 7. The hydraulic circuit 1 thus comprises, in addition to four non-return valves, a 4/3-way valve 60 and a 4/2-way valve 62, the 4/3-way valve being mechanically pretensioned and electrically adjustable, and the 4/2-way valve 62 having a plunger 66 which is restrained hydraulically on both sides. The position of the camshaft adjuster is chosen via the shunt 10 and its three positions 50, 52, 54. If that early or late position of the camshaft which is chosen is set in relation to the crankshaft or another camshaft, the valve remains in the blocking position 52. The hydraulic circuit on the other side of the supply throttles 38, 40 is decoupled from the hydraulic pump 5. The pump-protecting valves 44, 46 remain in the blocked state. Likewise, because the camshaft adjuster is integrated with the partial hydraulic circuit on the other side of the supply throttles 38, 40, almost no leakages occur via the leakage throttles 42 because of the blocking of the pump-protecting valves. If deflecting-in of an external moment of the camshaft 102 to the camshaft adjuster 100 takes place, one of the two non-return valves 12, 14 opens and ensures oppositely directed transfer of the hydraulic medium from one chamber to the other. The result is a possible relieving of the hydraulic load on one of the two chambers A, B via the 4/2-way valve 62 and the plunger position set by the hydraulic pretensioning.

Figure 4:
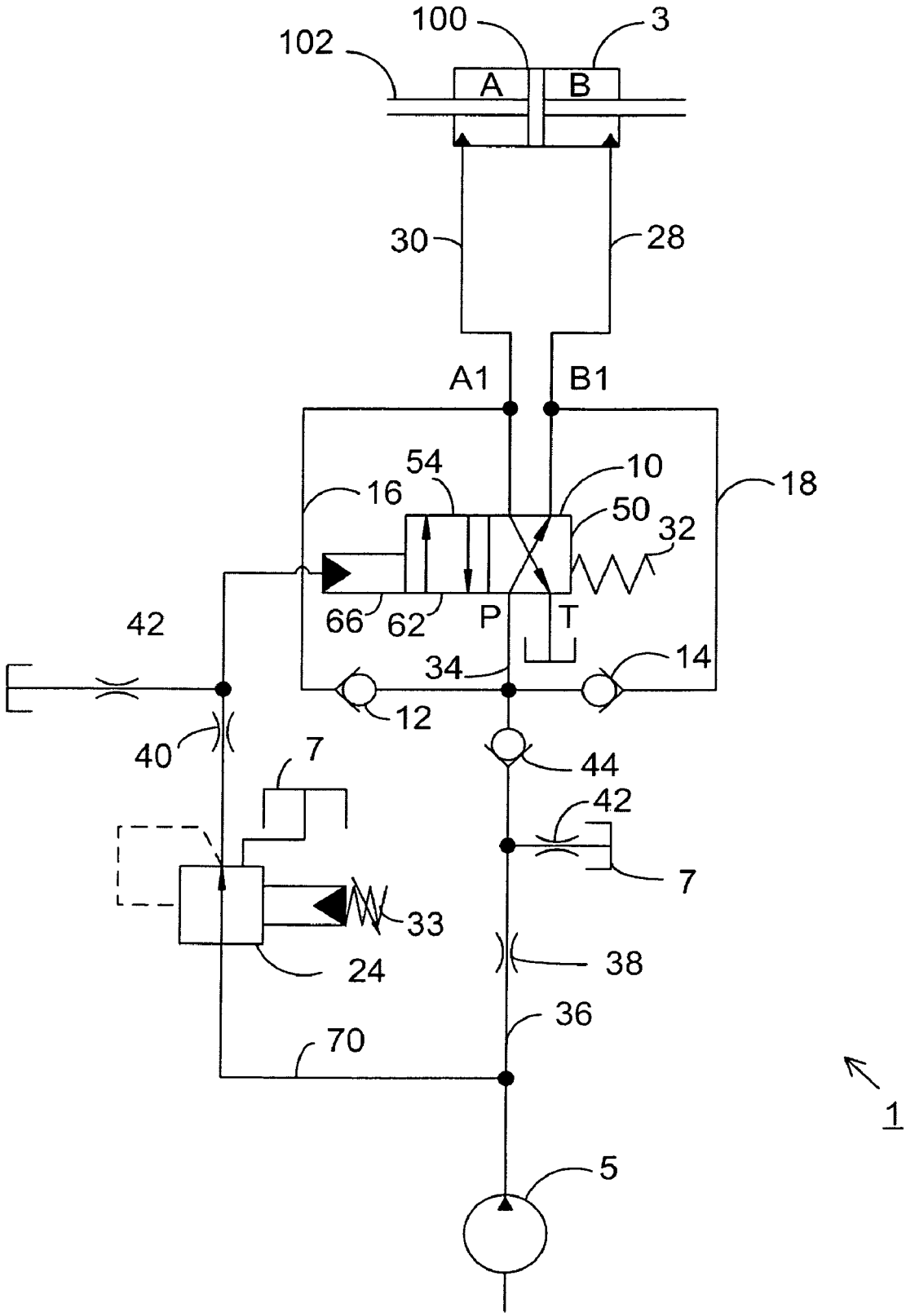
FIG. 4 shows a hydraulic circuit in accordance with a further example embodiment of the present invention.
Figure 5:
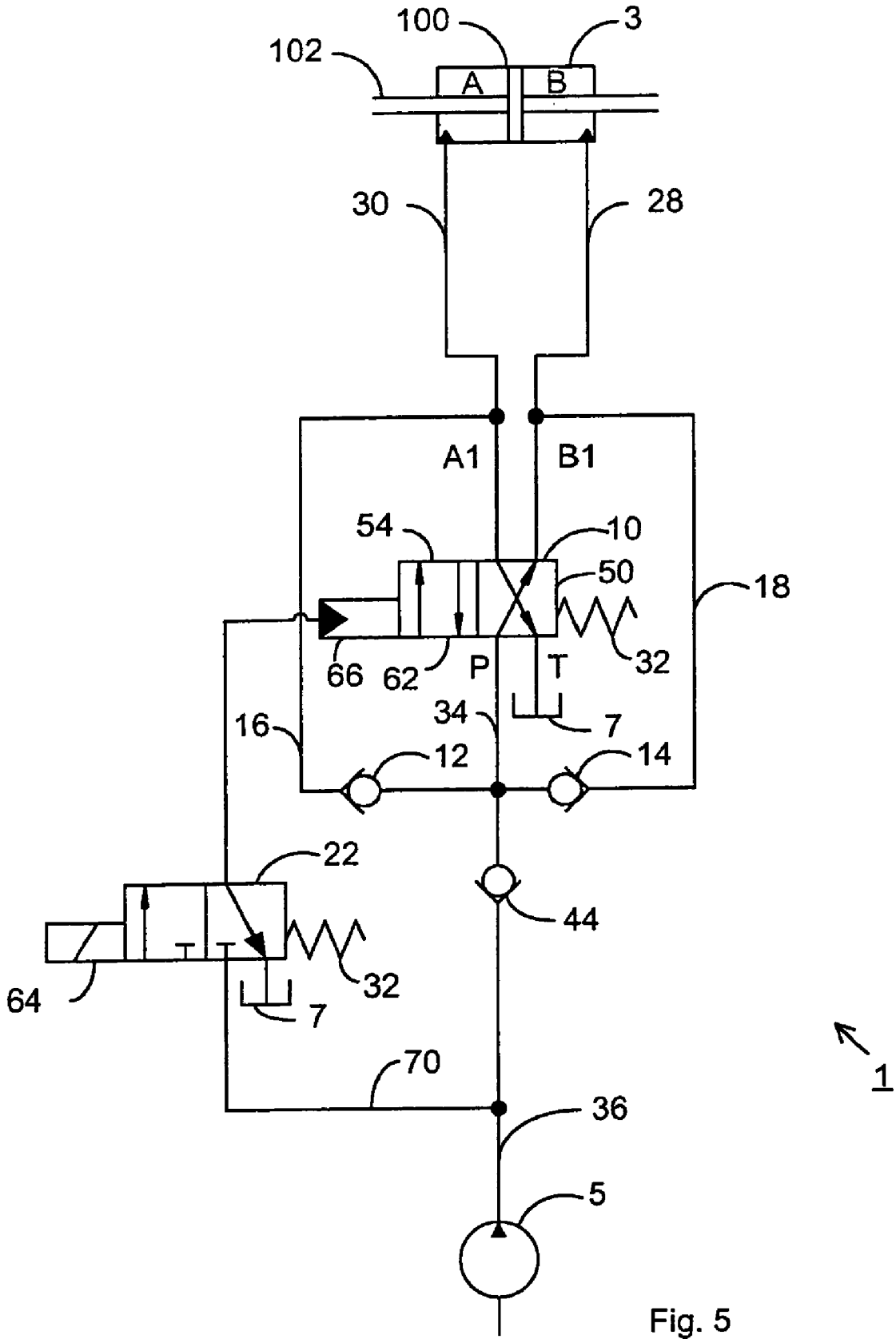
FIG. 5 shows a hydraulic circuit in accordance with a further example embodiment of the present invention.

FIGS. 4 and 5 show two very similar forms of an embodiment, according to the invention, of a hydraulic circuit 1 with a camshaft adjuster 100 which is represented in the form of a hydraulic piston 3. The hydraulic circuit 1 in FIG. 4 shows, diagrammatically, a hydraulic circuit for a hydraulic piston 3 or camshaft adjuster 100 which adjusts the camshaft 102 in a relative phase. The camshaft adjuster 100 has chambers A and B which move repeatedly in an oppositely oriented manner and can be hydraulically loaded with a hydraulic medium to different pressure levels via the infeed line 28 for the hydraulic chamber B and via the infeed line 30 for the hydraulic chamber A, in order to adjust the camshaft 102 into an early or late position. One infeed line for a number of hydraulic chambers A, B reduces the leakages and thereby the pressure losses in the system of the hydraulic circuit 1. Pointing from the output-side connections A1 and B1 in the infeed lines 28, are non-return lines 16, 18, into which non-return valves 12, 14 are incorporated in the blocking direction, in order to permit a passive, automatic transfer from one chamber to the corresponding counter-chamber. The hydraulic shunt 10 is a 4/2 valve which is pretensioned by means of a spring 32 and which is capable of adopting an alternating position between a position opening into the cross-type circuit arrangement 50 in the inoperative state and a position opening into the parallel circuit arrangement 54. The plunger of the valve is actuated hydraulically via a pressure-reducing valve 22 or a second pressure-reducing valve 24 which acts in a similar manner. The rotary lead-throughs in the example according to FIG. 4 are represented by the supply throttles 38, 40 which are arranged between the pressure generator, the hydraulic pump 5, and the pressure-reducing valve 24 on one side, and the shunt with the attached supply lines 16, 18, 28, 30 and the camshaft adjuster 100. Backflows from the system are fed back into the pan 7 of the tank of the engine sump at the pressure-reducing valve 24 (exemplified embodiment in FIG. 4), or pressure-reducing valve 22 (exemplified embodiment in FIG. 5), at the leakage points 42 and at the hydraulic shunt 10. The pressure-reducing valve 24 may be pretensioned by a spring 33. The non-return valve 24 protects the pump 5. Above all, the exemplified embodiment according to FIG. 4 integrates components such as the hydraulic shunt 10, the 4/2 valve and numerous non-return valves 12, 14 44 in the camshaft adjuster, preferably on the side which is remote from the camshaft.

In the exemplified embodiment in FIG. 4, the hydraulic shunt 10 is represented in the form of a 4/2 valve, also referred to as a "4/2-way valve", which is pretensioned on one side by the pretensioning spring 32. The two states of the 4/2-way valve 62 are the position opening into the parallel circuit arrangement 54 and the position opening into the cross-type circuit arrangement 50. The plunger of the valve 62 is a hydraulically controlled plunger 66. The P connection opens into the oil pan 7 of the internal-combustion engine. The two working connections A1 and B1, which lead, via the two infeed lines 28, 30, to the hydraulic chambers A, B of the hydraulic piston 3, are routed back, via the non-return lines 16, 18 having the two non-return valves 12, 14, to a hydraulic summation point in the pressure-supplying line 34 which points towards the P connection of the 4/2-way valve 62. In the hydraulic diagram of the hydraulic circuit 1 there can be seen a further non-return valve 44 which is arranged in the pressure-supplying line 36, on the camshaft-adjuster side and upstream of the leakage throttle 42 and the supply throttle 38, as a pump-protecting valve. A distributing line 70 leads from the pressure-supplying line 36 to the pressure-reducing valve 24 which is held in an inoperative position in a pretensioned manner by means of an adjustable pretensioning spring 33. Both the distributing line 70 and the pressure-supplying line 36 are supplied by the hydraulic pump 5. The pressure-reducing valve 24 is arranged on the engine block side, and a supply throttle 40 and leakage throttle 42 act, in a hydraulically sequential manner, in the direction of the hydraulically controlled plunger 66. The leakage throttles 42 likewise open into the oil pan 7. The hydraulic circuit 1 thus has four points at which oil can escape into the oil pan 7: at the 4/2-way valve 62, downstream of the first supply throttle 38; downstream of the second supply throttle 40, via the leakage throttle 42 in each case; and at the pressure-reducing valve 24. The 4/2-way valve 62 has only two positions, the blocking position 52 being dispensed with. If a moment is fed to the camshaft adjuster 100, so that the hydraulic chamber or chambers B is/are reduced, the excess hydraulic medium is fed into the summation point in the pressure-supplying line 34 via the infeed line 28, the non-return line 18 and the non-return valve 14. The pump-protecting valve 44 closes at approximately the same time, and thus decouples the hydraulic pump 5. The pressure peak is not able to pass through to the hydraulic pump 5 in a damaging manner, but is fed either into the chamber A or back into the chamber B via the 4/2-way valve 62 or the hydraulic shunt 10, depending upon the position of the hydraulically controlled plunger 66. It is thus possible to set the regulating quality by setting the pressure-reducing valve.

From FIG. 5, there can be seen a hydraulic circuit 1 which is very similar to that in FIG. 4, one difference being constituted by the pressure-reducing valve 22, which is spring-pretensioned on one side via the pretensioning spring 32 and which can be adjusted electrically by actuation of the electrically controlled plunger 64. Here too, the hydraulic circuit reacts in a manner similar to what is described in connection with FIG. 4, apart from the fact that a valve position can be chosen electrically from the vehicle control unit or the engine control unit. As regards the other, identical components of the hydraulic circuit 1, the reader is referred to the description of the drawings in connection with FIG. 4.

Figure 6:
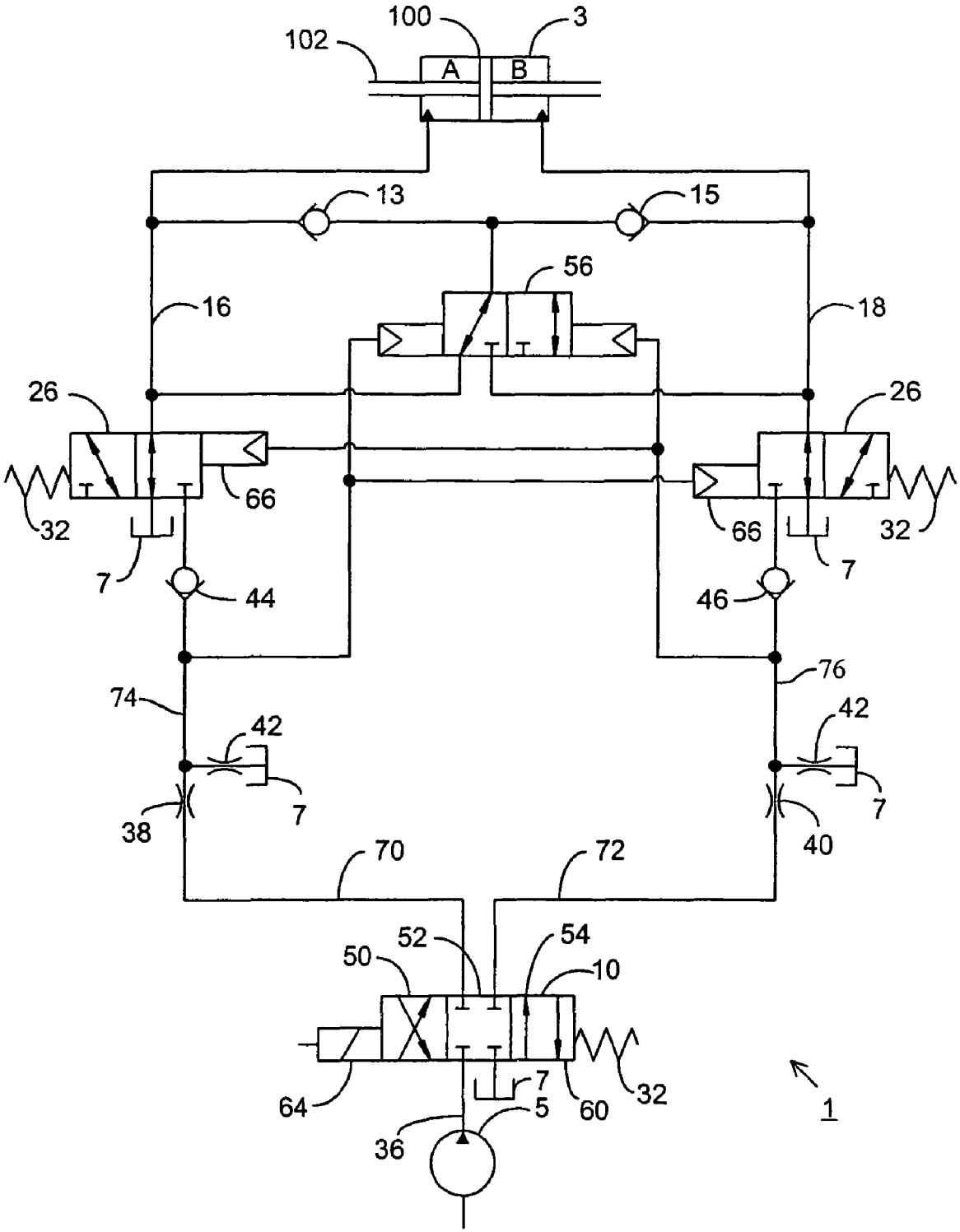
FIG. 6 shows a hydraulic circuit in accordance with a further example embodiment of the present invention.
Figure 7:
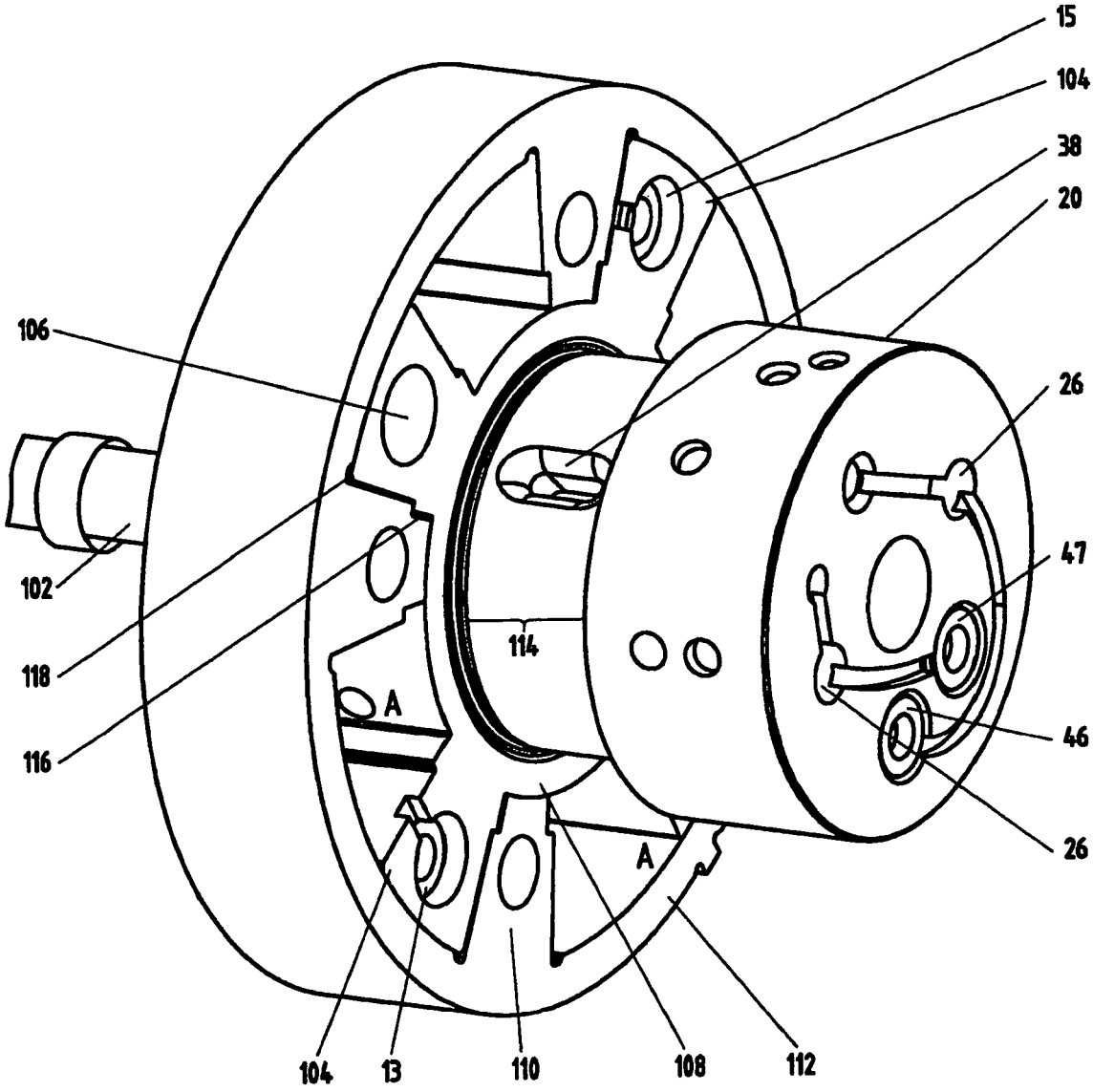
FIG. 7 shows a camshaft adjuster with axial prolongation of the central axis for the purpose of accommodating a partial hydraulic circuit in accordance with an example embodiment of the present invention.

FIG. 6 shows another hydraulic circuit 1 according to the invention which can be arranged in the camshaft adjuster 100 in the form of integrated components in a manner exactly similar to what is disclosed in the exemplified design according to FIG. 7. With the aid of the rotary lead-throughs, which are represented in the form of supply throttles 38, 40 with their appertaining, but often unwanted leakage throttles 42 discharging to the oil pan 7, the person skilled in the art is able to perceive that, in the present exemplified embodiment according to FIG. 6, all the components, apart from the hydraulic shunt 10, are incorporated in the camshaft adjuster 100. Leading up to the camshaft adjuster 100 from the hydraulic shunt 10, which is a 4/3 valve with spring pretensioning by the spring 32 for the defined adoption of an inoperative location, are two distributing lines 70, 72 which divide up, within the camshaft adjuster 100, into two control lines 74, 76 upstream of the non-return valves 44, 46 and two lines which continue onwards. The 4/3 valve has a position opening into the cross-type circuit arrangement 50, a position opening into the parallel circuit arrangement 54 and a blocking position 52, the position opening into the parallel circuit arrangement being the one which is adopted in the inoperative location. Because of the hydraulic coupling between the valves 26, a direction of inflow of the pressure supply from the hydraulic pump 5 into one of the chambers A, B of the camshaft adjuster 100 is opened alternately, while the other valve provides a direction of discharge to the pan 7. The pressure-equalising valve 56 is restrained hydraulically on both sides so that, depending upon the supplying position of the shunt 10, one of the two lines 16, 18, which at the same time form part of the non-return lines, is able to switch through the chambers A, B which are supplied with pressure. In the event of pressure excesses above the supply pressure in the lines to the chambers, the non-return valves 13, 15, together with the pressure-equalising valve 56, clear a hydraulic route in order to permit, under pulses of pressure or moment from the camshaft, discharges from the chamber which is diminishing into the chamber which is enlarging.

Represented in FIG. 7 is a design variant of the hydraulic circuit 1 of a camshaft adjuster 100 according to the invention with a camshaft 102. Located in the opposite direction to the camshaft is an axial prolongation 20 of the camshaft adjuster 100, in particular of the rotor 108. The rotor 108 merges into a rotor bearing 114 which is designed with a smaller diameter than the rotor 108 with its vanes 104 and the axial prolongation 20. Integrated into the rotor bearing 114 are rotary lead-throughs which are represented, in the circuit diagrams, as supply throttles 38. The apertures of the rotary lead-throughs in the rotor bearing 114, which is rigid in location, merge into oil ducts which constitute the control lines 74, 76 and supply lines 70, 72. Some of the supply lines and control lines turn away from the vanes 104 and lead, initially, into the axial prolongation 20. The avial prolongation 20 is designed, in a cap-like manner, as a cylindrical, circular structural section which, arranged approximately centrally and preferably in the center of gravity of the rotor 108, offers structural space for accommodating such components as non-return valves 44, 46 and two-way valves 26. As illustrated in the circuit diagram 1 in FIG. 6, lines pass from the cap to the vanes 104 and the chambers A, B. In some of the vanes 104, there are arranged non-return valves 13, 15 which clear the transfer routes from the chamber of the first type to the chambers of the second type in the camshaft adjuster 100 in each case, particularly in conjunction with the pressure-equalising valve 56. Locking apertures 106 may be arranged in other vanes 104. A third type of vane has no other functions of any kind, but is of solid configuration. If the vanes 104 strike against a side wall of the webs 110 (although the term "strike" is to be understood as meaning that no actual contact exists on account of a hydraulic damping chamber 116 and a dirt-collecting region 118), one of the chambers, e.g. the chamber A, is in its maximum expansion. In the event of vane positions that deviate from the maximum deflection, the hydraulic medium in one type of chamber, e.g. chamber type B, can be transferred into the chambers of the other type, e.g. chamber type A, via the appertaining non-return valve, e.g. non-return valve 15, through the fact that the non-return valve yields to the excess pressure and thus clears the way, optionally via a pressure-equalising valve 56 which may lie, for example, in the axial prolongation 20, to utilize the pulse guided in from the camshaft 102 and its gas exchange non-return valves (not represented), in order to use the energy in the hydraulic fluid for improving the regulating quality.

The other variant of embodiment for a hydraulic piston 3, particularly for a camshaft adjuster 100 having a camshaft 102, as illustrated in FIG. 6, represents an integrative variant of arrangement in greater detail. The supply throttles 38, 40 and the leakage throttles 42 are represented above the hydraulic shunt 10 which, in the present example, is a 4/3-way valve 60. Normally, the position of the camshaft adjuster 100 is set by the electrical activation of the electrically controlled plunger 64 of the 4/3-way valve 60 against the pretensioning force of the pretensioning spring 32. Depending upon the position chosen: the position opening into the cross-type circuit arrangement 50, the blocking position 52 or the position opening into the parallel circuit arrangement 54, the pressure can be fed, via the hydraulic medium, out of the hydraulic pump 5 and into the hydraulic chamber A or the hydraulic chamber B of the camshaft adjuster 100 via one of the two hydraulically controlled two-way valves 26. The two two-way valves 26 are alternately open and located in the feeding-through position. If hydraulic feeding-through by one two-way valve takes place, hydraulic blocking by the other two-way valve takes place at the same time. The control lines 74, 76, which are connected to a distributing line 70, 72 in each case, serve to set the position of the plunger. The control lines 74, 76 are connected upstream of the pump-protecting valves 44, 46 and downstream of the supply throttles 38, 40. The pressure-equalising valve 56 is likewise a two-way valve, whose piston is restrained on both sides by the control lines 74, 76. Connection takes place via either the first non-return line 16 or the second non-return line 18, depending upon the pressure conditions in the control lines. Arranged on the other side of the pressure-equalising valve 56 are two non-return valves 13, which are connected in an anti-parallel manner and which cause pressure peaks, which are directed from the hydraulic chambers A and B or, repeatedly, A and B of the camshaft adjuster 100, to be transferred into the other chamber in each case. The three valves 26 and 56 are blocked up, together with the non-return valves 44, 46, 13, 15, on the camshaft adjuster side. As the hydraulic shunt, use may be made of a current 4/3-way valve 60, with which every person skilled in the art is familiar. Improvement of the regulating quality takes place via the camshaft adjuster, in particular via the non-return valves 13, 15 and the appertaining hydraulic shunts.

FIG. 7 shows a complete constructional implementation of that portion of the hydraulic circuit 1 which is on the camshaft adjuster side in FIG. 6. In the camshaft adjuster 100, there can be seen a rotor 108 whose axial center is prolonged cylindrically in order to be able to accommodate the hydraulic arrangement of the valves 26, 56, 44 and 46. The rotor 108 moves in a swivelling fashion within its stator 112. Components are installed in the vanes 104 of the rotor 108. Two of the vanes 104 have the non-return valves 13, 15. A third vane has a locking aperture 106 for a known locking pin, such as is known, for example, from DE 10 2005 004 281 A1 (Hydraulik-Ring GmbH). The rotor 108 of the camshaft adjuster 100 is provided with numerous ducts in order to incorporate the non-return lines 16, 18, the control lines 74, 76 and the distributing lines 70, 72 in the rotor 108. The pump-protecting valves 44, 46, the two-way valves 26 and the pressure-equalising valve 56 are arranged in the axial prolongation 20.

Figure 8A:
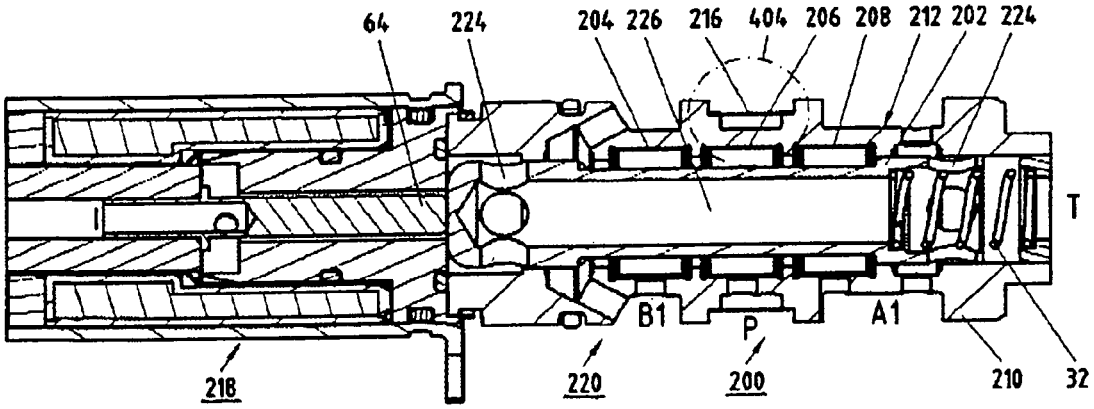
FIGS. 8*a* to 8*c* represent a possible valve with non-return strips, in three different switching positions, in accordance with example embodiment of the present invention.
Figure 8B:
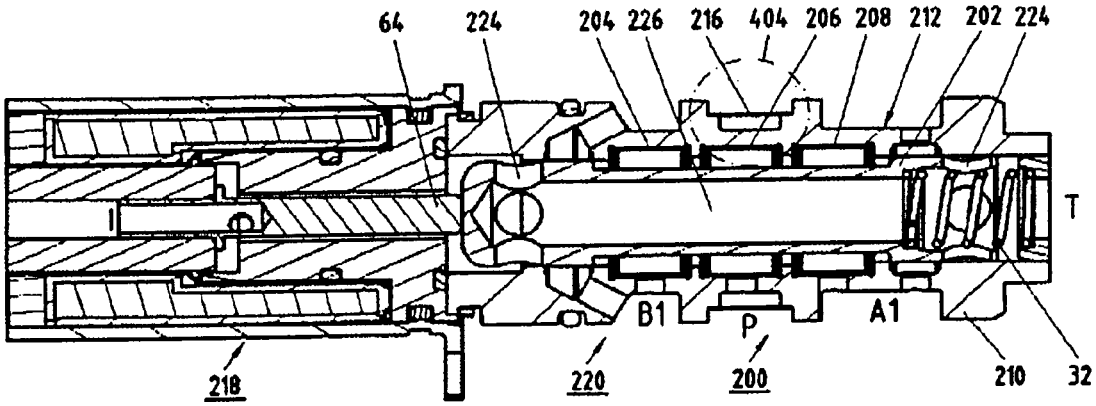
Figure 8C:
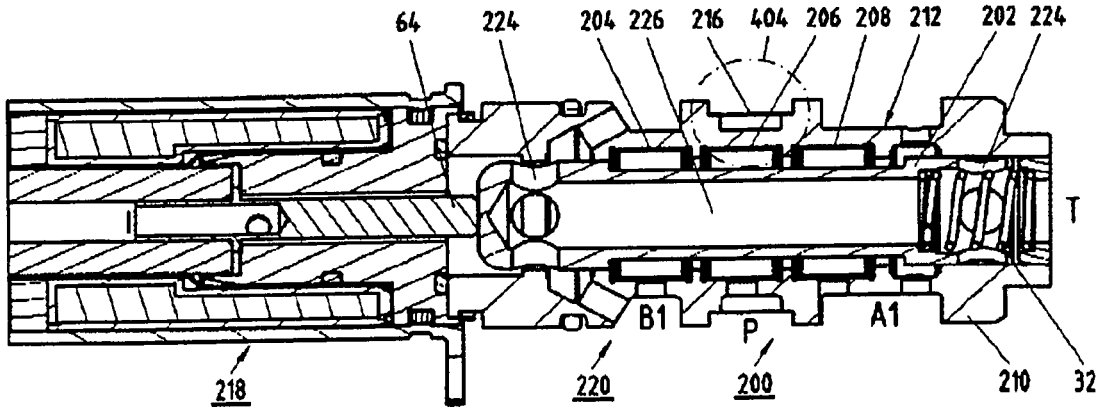

Instead of arranging the non-return valves and auxiliary valves within the camshaft adjuster 100 itself, it is possible to produce a large functionality assembly within a valve 200, as illustrated in FIGS. 8*a* to 8*c*. The valve whose construction is represented in FIG. 8*a* is similar to a diagrammatic representation in FIG. 9. FIGS. 8*a* to 8*c* illustrate, in sectional drawings, the same valve with different positions of the plunger and piston. The valve 200 comprises a magnetic part 218 and a hydraulic part 220. For the purpose of producing one variant of embodiment of the invention, an adapted hydraulic part 220 has been placed on a known magnetic part 218. The plunger, which may be controlled hydraulically or electrically according to choice but, in this case for example, is an electrically controlled plunger 64, displaces the hydraulic piston 202 against the pretensioning spring 32. The pretensioning spring 32 is immersed in oil, and the oil flows through it to the pan 7 via the connection T. The oil passes into the cavity 226 in the piston 202 via flow-off apertures 224. The connections for the hydraulic chambers A, B point into two perforating apertures A1 and B1 respectively. One of the perforations A1, B1 present in the sleeve has a strip-shaped non-return valve 204, 208 lying beneath it. One of the perforations is switched through alternately because of the run-off edges on the hydraulic piston 202. At the P connection, which is present approximately centrally, of the hydraulic part 220 of the valve 200, there is arranged, on the outside of the sleeve 210, a filter 216 which is preferably inserted permanently and under which there is positioned another strip-shaped ring 206 which, like the two strips 204, 208, also functions as a non-return valve. In the event of a pressure peak via the connection A to the strip-shaped ring 208, the non-return valve clears the path to the hydraulic piston 202, while the pump-protecting valve 404 consisting of the strip-shaped ring 206 decouples the pressure source at the connection P. The strips 204, 208, 206 are positioned below the surface 212. Instead of this, it is possible to transfer the pressure peak from the connection A to the connection B, depending upon the position of the hydraulic piston 202 which is recessed along a substantial part of its outer radius in order to form a continuous duct. This very compact practical embodiment of a valve 200, which is represented diagrammatically in FIG. 9, indicates a neat practical embodiment of the invention in the form of a cartridge valve 214 which can be screwed into known apertures in cylinder heads belonging to current internal-combustion engines.

Figure 9:
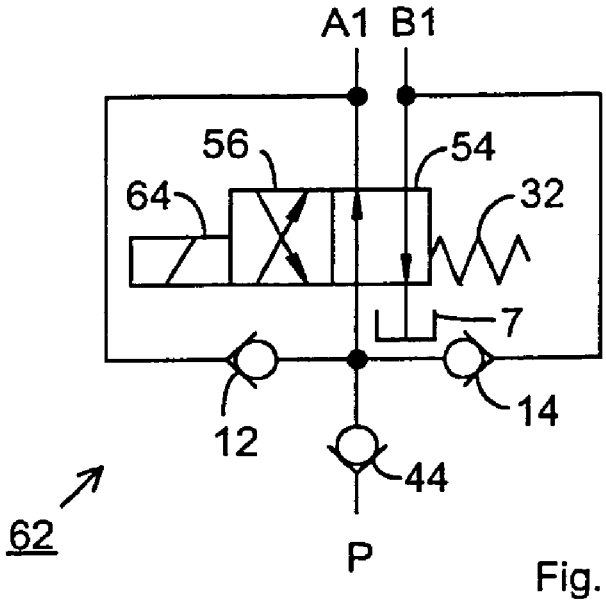
FIG. 9 shows a hydraulic shunt according to an example embodiment of the present invention.

By referring to FIGS. 2 to 6, in which similar parts have already been described, the 4/3-way valve 62 in FIG. 9 can be easily understood by studying it, if FIGS. 8*a* to 8*c* are consulted by way of assistance.

Figure 10:
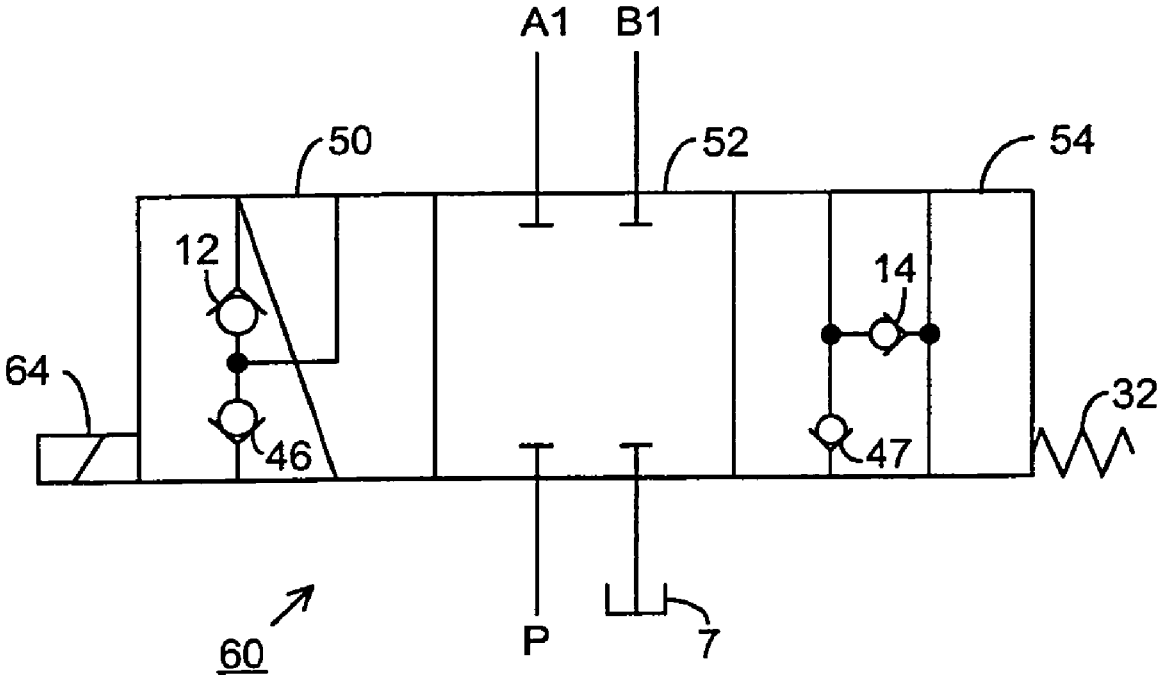
FIG. 10 shows a hydraulic shunt according to a further example embodiment of the present invention.

FIG. 10 discloses a 4/3-way valve 60 having the four connections P, T, A1 and B1. The three states are: the position opening into the cross-type circuit arrangement 50, the blocking position 52 and the position opening into the parallel circuit arrangement 54. On one side, the valve is spring-pretensioned by the pretensioning spring 32. The piston of the valve can be displaced against the spring by the electrically controlled plunger 64. With the knowledge of how non-return valves 12, 14 and pump-protecting valves 44, 46 can be produced by means of strips 204, 206, 208, a similar implementation to that according to FIG. 8 is possible on the basis of the valve diagrammatically represented in FIG. 10. Pump-protecting valves 46, 46 and the non-return valves 12, 14 point in opposite directions of flow. The non-return valves 12, 14 establish a connection between the connections A1, B1 if a pressure peak occurs on the side T which is not supplied with pressure but is relieved of pressure. At that moment, the pump-protecting valves 46, 47 close. The hydraulic source, for example in the form of the hydraulic pump 5, is decoupled and equalisation takes place between the chambers A and B of the camshaft adjuster 100 via one of the non-return valves 12, 14.

Figure 11:
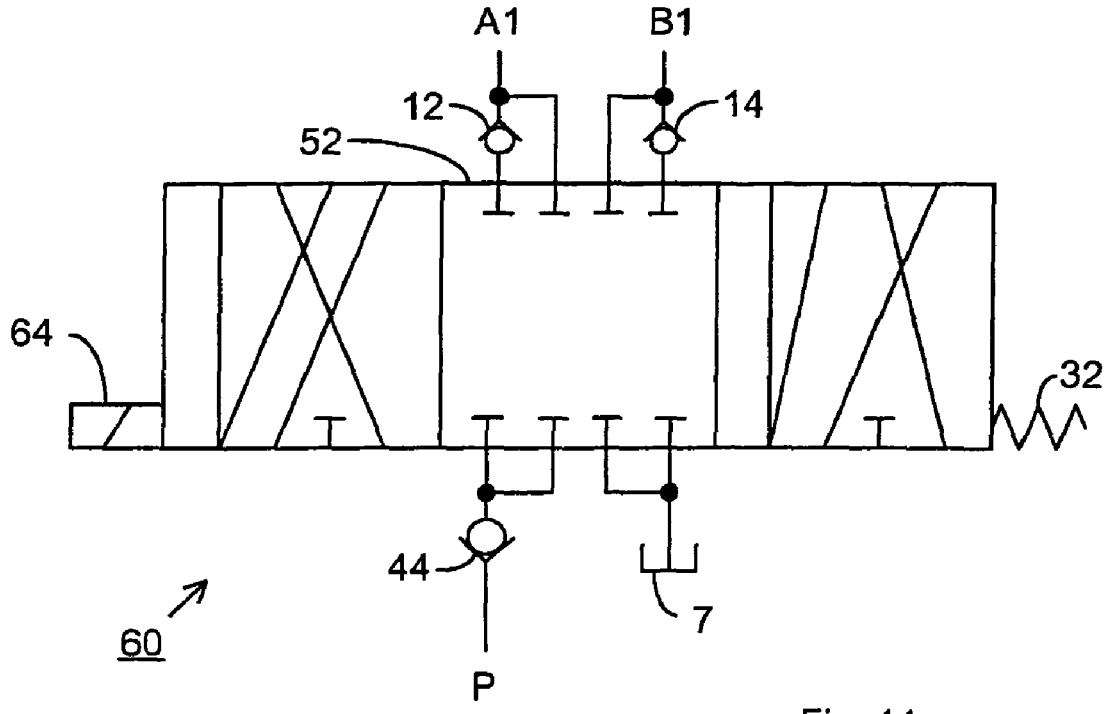
FIG. 11 shows a hydraulic shunt according to a further example embodiment of the present invention.

The 4/3-way valve 60 with the pretensioning spring 32 and the electrically controlled plunger 64 in FIG. 11 is similar to the valve in FIG. 10, although the valves 12, 14 and 44, which limit the direction of flow and open on one side, have been placed out of the actual piston region. 202 and are regarded as being connected upstream of the valve. It can be seen that a hydraulic piston 202 of this kind must use a number of cross-connections between the connections A1, B1, P and T. In the positions that form connections, i.e. in the first state and third state, the P connection is routed to at least two connections on the output side. Two other connections, a P connection and a T connection, are likewise routed to the other side of the valve or to the working connections A1, B1.

Figure 12:
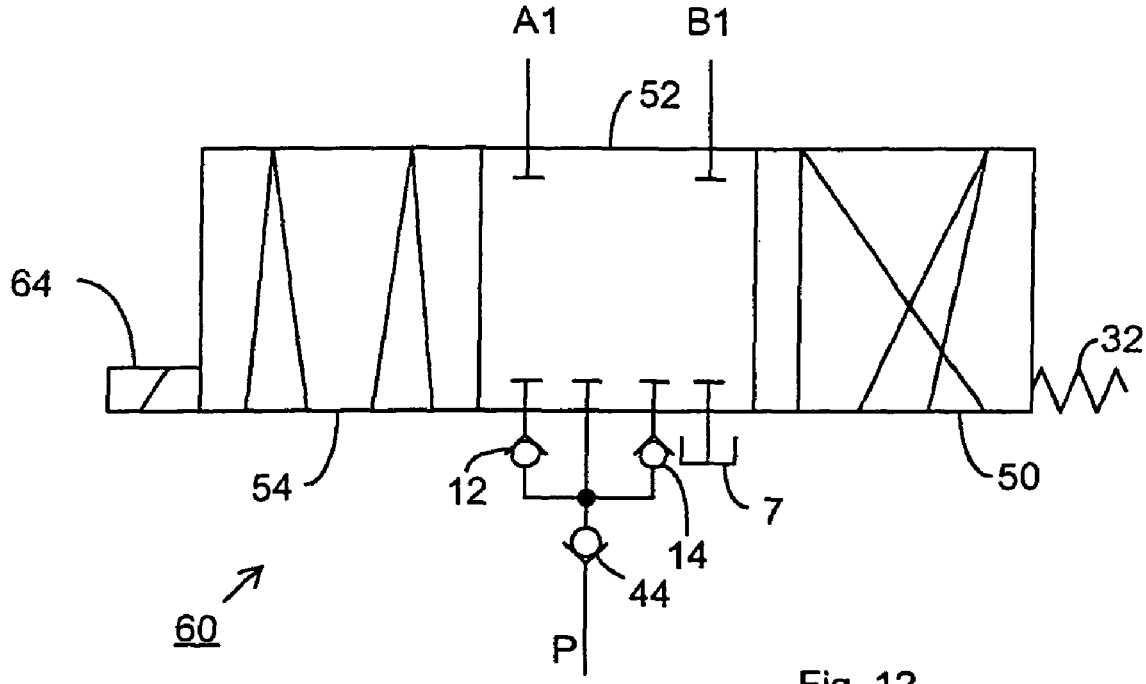
FIG. 12 shows a hydraulic shunt according to a further example embodiment of the present invention.

A 4/3-way valve 60, whose non-return valves 12, 14 have not been positioned on the working-connection side but are provided on the pressure-supplying side of the connection P, is likewise represented in FIG. 12. If FIG. 11 is compared with FIG. 12, it can be seen that the chosen arrangement of the non-return valves elsewhere results, if the pump-protecting valve 44 is retained at the P connection, in other internal bridging via the choice of edges of the hydraulic piston 202 of the valve 200. The valve displays, viewed from the working connections A1, B1 in each case, a doubly connected attachment to the connections P and T. The position opening into the cross-type circuit arrangement 50 and the position opening into the parallel circuit 54 can be found again here, then, in individual positions in addition to the blocking position 52. The positions defined above cannot be applied in such a direct way to the practical embodiment according to FIG. 11.

Figure 13:
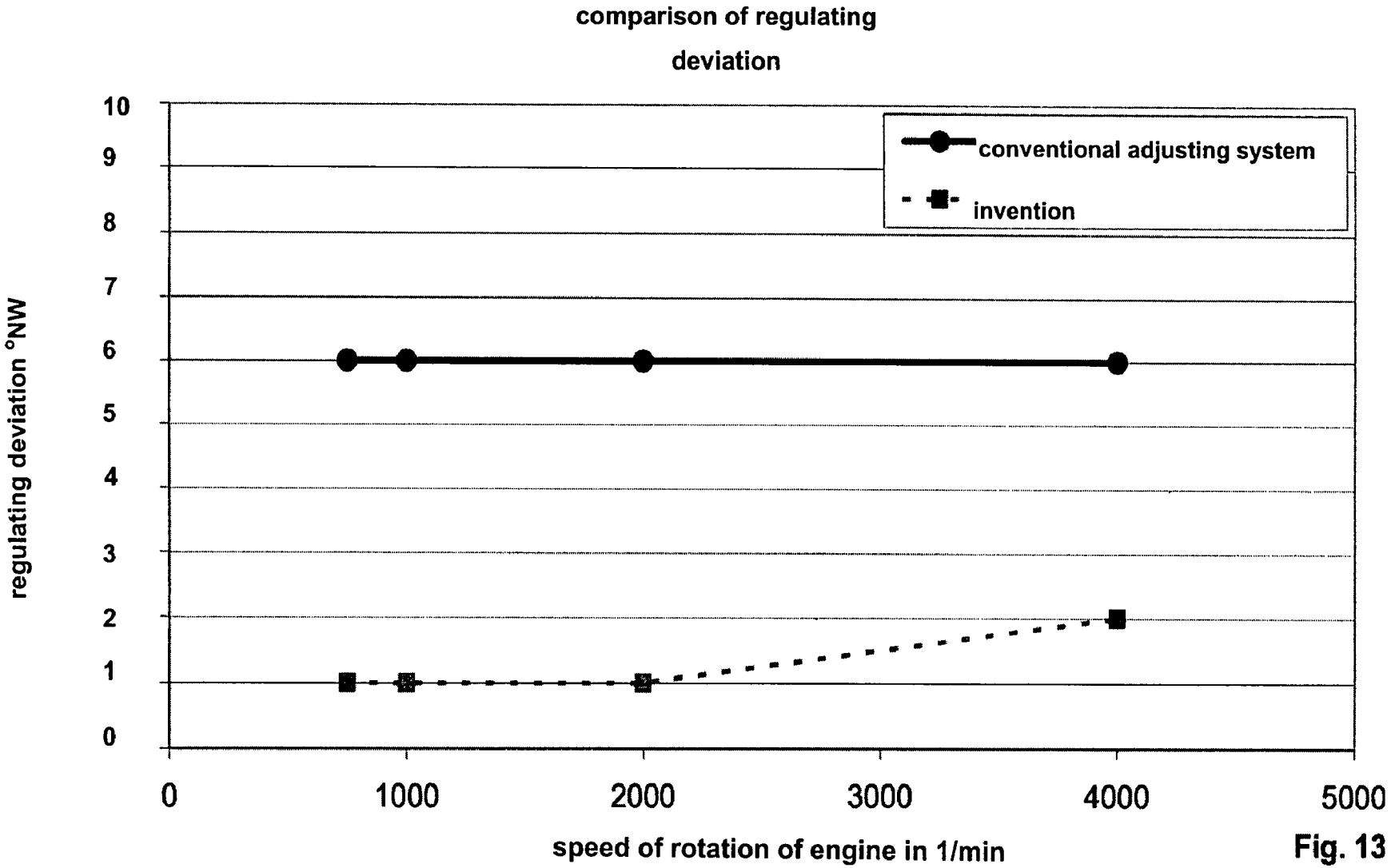
FIG. 13 represents a measurement or computation record for various systems according to an example embodiment of the present invention as compared to a conventional, known system.

FIG. 13 represents the regulating deviation of a conventional camshaft adjuster system (topmost line) in relation to the various systems according to the invention.

The regulating deviation is noted on the y axis. The rotational speed of the engine is noted on the x axis. Various rotational running speeds of the internal-combustion engine are illustrated, namely 750 rpm, 1,000 rpm, 2,000 rpm and 4,000 rpm. Only at relatively high rotational speeds does the regulating deviation deviate, with respect to the camshaft, to 2° just once, compared to 1° in the remaining cases. Without feedback via non-return valves in the blocking direction, the regulating deviation remains at values which are as high as 6° for example.

The teaching put forward indicates various exemplified embodiments showing how it is possible, by means of favourably positioned non-return valves inside a camshaft adjuster, or a camshaft adjuster valve and a number of non-return lines, to construct a passively operating camshaft adjuster system which stabilises itself, as a whole, by means of rapid transfers brought about by torques or extraneous forces which are fed in. Only a small number of moving parts is needed. The absolute pressure values are of secondary importance. The work is carried out by means of relative pressure differences, compared to the pressure supply. Because of the short paths, particularly in the case of integration or partial integration in the camshaft adjuster, it is not necessary to provide major additional quantities of oil. As a result of awareness of the non-return valve, which is simple to produce and can be integrated in the hydraulic shunt on a multiple basis, the hydraulic circuits represented even out the speed of angular adjustment of the camshaft adjuster. A system has been designed which is failure-tolerant, is easy to construct and manages with few moving parts. The invention can therefore be applied to a valve and a suitable hydraulic circuit, particularly for camshaft adjusters in an internal-combustion engine, in which a number of non-return valves, or two-way valves functioning as non-return valves, are positioned in order to provide a rapid camshaft adjuster with a high regulating quality.

Listing of reference numerals

| Reference numeral | Designation |
|---|---|
| 1 | hydraulic circuit of motor vehicle |
| 3 | hydraulic piston |
| 5 | hydraulic pump |
| 7 | pan in the form of an engine sump |
| 9 | axial center |
| 10 | shunt adjustment/valve |
| 12 | non-return valve |
| 13 | non-return valve |
| 14 | non-return valve |
| 15 | non-return valve |
| 16 | non-return line |
| 18 | non-return line |
| 20 | axial prolongation |
| 22 | pressure-reducing valve |
| 24 | pressure-reducing valve |
| 26 | two-way valve |
| 28 | infeed line |
| 30 | infeed line |
| 32 | pretensioning spring |
| 33 | pretensioning spring, adjustable |
| 34 | pressure-supplying line |
| 36 | pressure-supplying line |
| 38 | supply throttle |
| 40 | supply throttle |
| 42 | leakage throttle |
| 44 | pump-protecting valve |
| 46 | pump-protecting valve, first |
| 47 | pump-protecting valve, second |
| 50 | position opening into cross-type circuit arrangement |
| 52 | blocking position |

-continued

Listing of reference numerals

| Reference numeral | Designation |
|---|---|
| 54 | position opening into parallel circuit arrangement |
| 56 | pressure-equalising valve |
| 60 | 4/3-way valve |
| 62 | 4/2-way valve |
| 64 | electrically controlled plunger |
| 66 | hydraulically controlled plunger |
| 70 | distributing line |
| 72 | distributing line |
| 74 | control line, first |
| 76 | control line, second |
| 100 | camshaft adjuster |
| 102 | camshaft |
| 104 | vane |
| 106 | locking aperture |
| 108 | rotor |
| 110 | web |
| 112 | stator |
| 114 | rotor bearing |
| 116 | hydraulic damping chamber |
| 118 | dirt-collecting region |
| 200 | valve |
| 202 | hydraulic piston |
| 204 | strip-shaped ring |
| 206 | strip-shaped ring |
| 208 | strip-shaped ring |
| 210 | sleeve |
| 212 | surface |
| 214 | cartridge valve |
| 216 | filter |
| 218 | magnetic valve |
| 220 | hydraulic part |
| 224 | flow-off aperture |
| 226 | cavity |
| 250 | hydraulic pressure |
| 404 | pump-protecting valve |
| A, B | hydraulic chambers |
| F/F+/F− | external force |
| P | input side/pressure-loaded connection |
| A1/B1 | output side/working connection |
| M+/M− | fluctuations in moment |
| M+ | rising moment |
| T | tank connection |

What is claimed is:

1. A hydraulic circuit of a motor vehicle, comprising:

a hydraulic piston which has at least two oppositely oriented hydraulic chambers and is acted upon by an external force in one of an alternating manner or in a rising manner, the hydraulic piston performing a positional variation as a result of differing pressure loading on the oppositely oriented hydraulic chambers, a hydraulic shunt for controlling the differing pressure loading and drawing a hydraulic medium from a hydraulic pressure source, and at least one non-return valve, wherein:

the hydraulic circuit belongs to an internal-combustion engine;

the hydraulic piston comprises a swivel-motor-type camshaft adjuster into which an alternating force of at least one camshaft is fed;

in addition to the pressure loading via a hydraulic adjustment of the shunt, a pressure loading on the hydraulic medium by the hydraulic piston from a negative constituent of the alternating force is utilized, by opening at the at least one non-return valve, to vary the position of the hydraulic piston;

the negative constituent of the alternating force is fed in, via the at least one non-return valve operating as a bypass;

the hydraulic medium comprises engine oil;

the at least one non-return valve establishes, in a blocking direction, a connection from a hydraulically pressure-loaded input side of the hydraulic shunt to at least one corresponding output side of the hydraulic shunt, the at least one corresponding output side being in communication with at least one corresponding hydraulic chamber.

2. A hydraulic circuit of a motor vehicle, in accordance with claim 1, wherein the negative constituent of the alternating force is fed in upstream of the shunt.

3. A hydraulic circuit of a motor vehicle, in accordance with claim 2, wherein the negative constituent of the alternating force is fed in, via the at least one non-return valve operating as a bypass, upstream of the shunt on a side which is continuously loaded with pressure.

4. A hydraulic circuit of a motor vehicle, in accordance with claim 2, wherein the at least one non-return valve is arranged in such a way that feeding-through from one of the chambers of the piston is made possible only in the direction of the pressure side of the shunt.

5. A hydraulic circuit of a motor vehicle, in accordance with claim 1, wherein the hydraulic chambers are in communication with one another via the at least one non-return valve via which the pressure loading on the hydraulic medium which is produced from a negative constituent of an alternating force is transferred from the chamber which is diminishing in size into the chamber which is increasing in size, if the amount of the pressure arising from the alternating force exceeds the pressure in an infeed line to the chamber which is increasing in size.

6. A hydraulic circuit of a motor vehicle, in accordance with claim 5, wherein the hydraulic chambers are in direct communication with one another via the at least one non-return valve.

7. A hydraulic circuit of a motor vehicle, in accordance with claim 1, wherein pretensioning of the shunt takes place one of hydraulically, mechanically, in a mechanical/hydraulic combination, electrically, magnetically, or in an electromagnetic combination.

8. A hydraulic circuit of a motor vehicle, in accordance with claim 1, wherein a choice of direction of the hydraulic piston can be adjusted by a hydraulically controlled valve.

9. A hydraulic circuit of a motor vehicle, in accordance with claim 1, wherein the pressure loading can be connected, by a hydraulically controlled valve, from one of the hydraulic chambers to the other hydraulic chamber.

10. A hydraulic circuit of a motor vehicle, in accordance with claim 1, wherein the at least one non-return valve is integrated with the hydraulic shunt to form a single component.

11. A hydraulic circuit of a motor vehicle, in accordance with claim 1, wherein:

the oppositely oriented hydraulic piston and the hydraulic shunt are combined to form an integrated component, components of the shunt, including at least one pressure reducing valve, the at least one non-return valve, and at least one two-way valve are arranged in the axial center or axial prolongation of the integrated component.

12. A hydraulic circuit of a motor vehicle, in accordance with claim 1, wherein the hydraulic circuit comprises a partial hydraulic circuit which consists of at least three hydraulically controlled valves and makes it possible to use a negative constituent of an alternating force by alternately obstructing and clearing two feed lines and two return lines.

13. A hydraulic circuit of a motor vehicle, in accordance with claim 1, wherein the pressure loading takes place via a hydraulic adjustment of a shunt by a pretensioned valve.

* * * * *